US011020292B2

(12) United States Patent
Richardson

(10) Patent No.: US 11,020,292 B2
(45) **Date of Patent: *Jun. 1, 2021**

(54) COLLAPSIBLE CADAVER RACK

(71) Applicant: Trailerlogic, LLC, Belton, SC (US)

(72) Inventor: Michael P. Richardson, Anderson, SC (US)

(73) Assignee: TRAILERLOGIC, LLC, Belton, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/242,996

(22) Filed: Jan. 8, 2019

(65) Prior Publication Data

US 2019/0142657 A1 May 16, 2019

Related U.S. Application Data

(62) Division of application No. 12/558,209, filed on Sep. 11, 2009, now Pat. No. 10,172,749.

(51) Int. Cl.

| | |
|---|---|
| ***A61G 1/013*** | (2006.01) |
| ***A47B 43/00*** | (2006.01) |
| ***A61G 21/00*** | (2006.01) |

(52) U.S. Cl.

CPC ..... *A61G 1/013* (2013.01); *A47B 43/00* (2013.01); *A61G 21/00* (2013.01)

(58) Field of Classification Search

CPC ..... A61G 21/00; A61G 1/013; A47B 43/00
USPC ..... 211/13.1, 85.8, 27, 28, 49.1, 85.16, 211/85.27, 60.1, 121, 122, 151, 149, 189, 211/201, 195, 186; 108/163, 170, 166, 108/173, 175, 115; 280/20, 79.3, 79.11; 5/620, 115, 116, 117

See application file for complete search history.

(56) References Cited

U.S. PATENT DOCUMENTS

| | | | | |
|---|---|---|---|---|
| 148,713 | A * | 3/1874 | Kimball | A47F 5/13 211/201 |
| 388,281 | A * | 8/1888 | Johnson | A47F 5/13 211/189 |
| 471,697 | A * | 3/1892 | Mosbacher | A47B 47/028 108/188 |
| 874,159 | A | 12/1907 | Brusis | |
| 909,336 | A * | 1/1909 | Riedy | A47F 7/30 108/106 |
| 968,201 | A * | 8/1910 | Shannon | A47F 5/0093 211/134 |
| 982,477 | A * | 1/1911 | Cavanagh | A47G 25/10 211/149 |

(Continued)

FOREIGN PATENT DOCUMENTS

| | | | |
|---|---|---|---|
| CA | 2689678 | A1 | 4/2008 |
| CH | 693842 | A5 | 3/2004 |

(Continued)

OTHER PUBLICATIONS

European Search Report in EP Application No. EP10163438 dated Nov. 29, 2011.

(Continued)

*Primary Examiner* — Stanton L Krycinski

(74) *Attorney, Agent, or Firm* — Nelson Mullins Riley & Scarborough LLP

(57) ABSTRACT

The present invention relates to a collapsible rack for storing and transporting cadavers and human bodies.

8 Claims, 15 Drawing Sheets

(56) References Cited

U.S. PATENT DOCUMENTS 1,178,258 A 4/1916 Moore
1,407,607 A * 2/1922 Wakeham ..... F26B 25/18 211/201
1,563,057 A * 11/1925 Williams ..... B62B 3/006 211/134
1,626,507 A * 4/1927 Camper ..... D06F 57/08 211/182
1,716,466 A * 6/1929 Sims ..... A47B 3/12 211/149
1,727,048 A * 9/1929 Cady ..... A47B 43/00 108/115
1,737,971 A * 12/1929 Law ..... A47B 47/027 211/182
1,929,467 A * 10/1933 Bales ..... A47B 57/00 108/102
1,991,397 A * 2/1935 Lampman ..... A21B 3/00 211/182
2,398,730 A 4/1946 Terry
2,440,513 A 4/1948 Kaelin et al.
2,456,024 A 12/1948 Schofield
2,520,128 A 4/1950 Cushman
2,599,670 A * 6/1952 Thomas ..... E04G 1/154 182/152
2,726,407 A * 12/1955 Dean ..... A61G 7/00 280/79.3
2,748,955 A * 6/1956 Anselmo ..... A47B 43/00 211/182
2,774,609 A * 12/1956 Winger ..... B62B 3/02 280/79.11
2,950,014 A * 8/1960 Sullivan ..... A47B 88/487 211/151
2,969,863 A * 1/1961 Woldring ..... B65G 1/023 193/35 R
2,978,225 A 4/1961 Dallas, Jr.
3,221,216 A 12/1965 Coleman, Jr. et al.
3,240,505 A * 3/1966 Schlernitzauer ..... A22C 15/003 211/201
3,358,300 A 12/1967 Smith
3,463,265 A * 8/1969 Clover ..... E04G 1/34 182/119
3,527,174 A * 9/1970 Lay ..... A47B 31/04 108/115
3,559,339 A * 2/1971 Worley ..... A01G 9/12 211/189
3,567,039 A * 3/1971 Evans ..... B65G 1/0435 211/13.1
3,834,549 A * 9/1974 Burg ..... A47B 47/0016 108/187
3,967,327 A * 7/1976 Severson ..... A47C 19/12 5/9.1
4,006,500 A 2/1977 Bonifay
4,132,262 A 1/1979 Wibell
4,178,032 A 12/1979 Hone
4,245,849 A * 1/1981 Thiboutot ..... A47C 4/286 248/436
D267,373 S * 12/1982 Behrens ..... D34/21
4,397,432 A 8/1983 Resetar
4,453,641 A * 6/1984 Rasmussen ..... A47F 1/12 211/151
4,485,578 A * 12/1984 Novey ..... A01K 97/10 211/68
4,512,591 A * 4/1985 Plante ..... B62B 3/002 108/109
4,522,130 A * 6/1985 Worthington ..... A47B 31/04 108/159
4,648,517 A * 3/1987 Schafer ..... A47B 96/1475 108/162
4,691,762 A 8/1987 Elkins et al.
5,131,547 A * 7/1992 Goldberg ..... A47F 5/13 108/166
5,241,951 A 9/1993 Mason et al.
5,259,518 A * 11/1993 Sorenson ..... B65G 1/023 211/151
5,279,430 A * 1/1994 Benton ..... B65G 1/023 211/151
5,295,591 A * 3/1994 Slater ..... A47B 47/027 211/151
5,372,339 A 12/1994 Morgan
5,383,629 A 1/1995 Morgan
5,577,622 A * 11/1996 Kapteyn ..... A47F 5/0025 211/133.1
5,613,730 A 3/1997 Bluie et al.
5,806,335 A 9/1998 Herbert et al.
5,873,642 A * 2/1999 Domenig ..... B42F 15/0094 16/93 R
5,957,309 A * 9/1999 Hall ..... B62B 3/188 211/126.2
6,095,347 A * 8/2000 Mauro-Vetter ..... B65G 1/08 211/151
6,132,158 A * 10/2000 Pfeiffer ..... B65G 1/023 193/35 R
6,186,725 B1 * 2/2001 Konstant ..... B65G 1/08 193/36
6,230,908 B1 * 5/2001 Sloan ..... B65G 1/023 193/35 A
6,431,808 B1 * 8/2002 Lowrey ..... B65G 1/023 193/35 R
6,488,160 B2 * 12/2002 Wang ..... A47F 7/19 211/195
6,520,357 B1 * 2/2003 Kautz ..... A47B 96/061 211/151
6,588,608 B2 * 7/2003 Pater ..... B65G 1/02 211/151
6,604,640 B1 * 8/2003 Jehin ..... A47B 47/027 211/189
6,669,213 B2 * 12/2003 Woerner ..... B62B 3/002 280/47.35
RE38,517 E * 5/2004 Pfeiffer ..... B65G 1/023 193/35 R
6,851,564 B2 * 2/2005 Ng ..... A47B 43/00 211/149
6,923,606 B2 8/2005 Fehrle et al.
6,951,441 B2 * 10/2005 Weaver ..... B65G 1/023 193/35 C
7,185,899 B2 * 3/2007 Thiede ..... A47B 46/00 211/189
7,328,926 B1 2/2008 Myers et al.
7,568,241 B2 * 8/2009 Roberts ..... A61G 1/0293 5/620
7,637,220 B2 * 12/2009 Fu ..... A47B 43/00 108/115
RE41,763 E * 9/2010 Ng ..... A47B 43/00 211/149
8,210,312 B1 * 7/2012 Tetreault, Jr. ..... E06C 7/16 182/118
2002/0139766 A1 * 10/2002 Courtwright ..... B65G 1/026 211/191
2004/0178156 A1 * 9/2004 Knorring, Jr. ..... A47F 1/12 211/59.2
2004/0226491 A1 * 11/2004 Chen ..... A47B 3/002 108/124
2006/0048520 A1 3/2006 Huang et al.
2007/0012837 A1 * 1/2007 Stuart ..... A47B 96/063 248/241
2007/0118194 A1 5/2007 Mason et al.
2008/0063771 A1 3/2008 Dumm
2008/0156755 A1 * 7/2008 Wang ..... A47B 43/00 211/85.3
2008/0307822 A1 12/2008 Richardson
2009/0120887 A1 * 5/2009 Meehan ..... B65D 19/385 211/85.8
2009/0240312 A1 9/2009 Koewler
2010/0186435 A1 7/2010 Vogel et al.
2010/0300993 A1 * 12/2010 Ho ..... A47B 47/021 211/13.1
2010/0326938 A1 * 12/2010 Zhu ..... A47B 31/04 211/149

(56) References Cited

U.S. PATENT DOCUMENTS

| | | | | |
|---|---|---|---|---|
| 2011/0062098 | A1* | 3/2011 | Richardson | A47B 43/00 211/85.8 |
| 2011/0068072 | A1* | 3/2011 | Zhu | A47B 31/04 211/149 |
| 2011/0240571 | A1* | 10/2011 | Ho | A47B 47/021 211/13.1 |

FOREIGN PATENT DOCUMENTS

| | | | | |
|---|---|---|---|---|
| DE | 4131368 | A1 * | 3/1993 | A47B 43/00 |
| DE | 9411381 | U1 * | 11/1994 | A47B 43/00 |
| FR | 2059684 | A1 | 6/1971 | |
| GB | 21085 | A | 10/1915 | |
| GB | 2457627 | A | 8/2009 | |
| JP | 04105609 | A * | 4/1992 | |
| JP | 2009137672 | A | 6/2009 | |
| JP | 2009203032 | A | 9/2009 | |
| WO | WO 97/24088 | A1 | 7/1997 | |
| WO | WO 98/23236 | A1 | 6/1998 | |
| WO | WO 08/135710 | A2 | 11/2008 | |

OTHER PUBLICATIONS

Observation filed with the European Patent Office on Jul. 31, 2011.
Observation filed with the European Patent Office on Jan. 19, 2011.
Bernard et al., Treatment of Comatose Survivors of Out-of-Hospital Cardiac Arrest with Induced Hypothermia, Retrieved from the Internet: <URL:http://hypothermia.emcrit.org/hypoarts/bernard.pdf> (retrieved on Jan. 27, 2011).
PCT Invitation to Pay Additional Fees and, where applicable, protest fee, dated Dec. 17, 2010, for International Application No. PCT/US2010/048383.
PCT Notification of Transmittal of the International Search Report and the written opinion of the International Searching Authority, or the declaration, PCT International Search Report, PCT Written Opinion of the International Searching Authority, dated Feb. 17, 2011, for International Application No. PCT/US2010/060991.

* cited by examiner

COLLAPSIBLE CADAVER RACK

RELATED APPLICATIONS

This application is a divisional of non-provisional U.S. application Ser. No. 12/558,209, filed on Sep. 11, 2009 (now U.S. Pat. No. 10,172,749), the entire disclosure which is incorporated by reference as if set forth verbatim herein.

FIELD OF THE INVENTION

The present invention is directed to a collapsible rack for storing and transporting cadavers and human bodies.

SUMMARY OF THE INVENTION

One embodiment of the present invention is a collapsible cadaver rack that has at least two vertically-oriented geometrically-shaped supports having at least one horizontal beam internally positioned within each support. The vertically-oriented geometrically-shaped supports are collapsibly connected to each other by frame members such that the rack can be oriented in a first open position where the frame members are in a substantially horizontal position, and a second collapsed position where the frame members are in a substantially vertical position. The collapsible cadaver rack also has at least two removable guide rails which abut a horizontal beam of each vertically-oriented support and where each removable guide rail may be positioned at different locates along the horizontal beams such that the space between the at least two removable guide rails is variable. The removable guide rails may be positioned within the collapsible cadaver rack when the collapsible cadaver rack is in a first open position.

Another embodiment is a collapsible cadaver rack that has at least two vertically-oriented geometrically-shaped supports having at least one horizontal beam internally positioned within each support. The vertically-oriented geometrically-shaped supports are collapsibly connected to each other by frame members such that the rack can be oriented in a first open position where the frame members are in a substantially horizontal position, and a second collapsed position where the frame members are in a substantially vertical position. And adjacent vertically oriented supports are further connected by a support brace when the rack is in a first position. The collapsible cadaver rack also has at least two removable guide rails which abut a horizontal beam of each vertically-oriented support and where each removable guide rail may be positioned at different locates along the horizontal beams such that the space between the at least two removable guide rails is variable. The removable guide rails may be positioned within the collapsible cadaver rack when the collapsible cadaver rack is in a first open position.

The accompanying drawings, which are incorporated in and constitute a part of this specification, illustrate one or more embodiments of the invention, and together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which refers to the appended drawings, in which.

Figure 1:
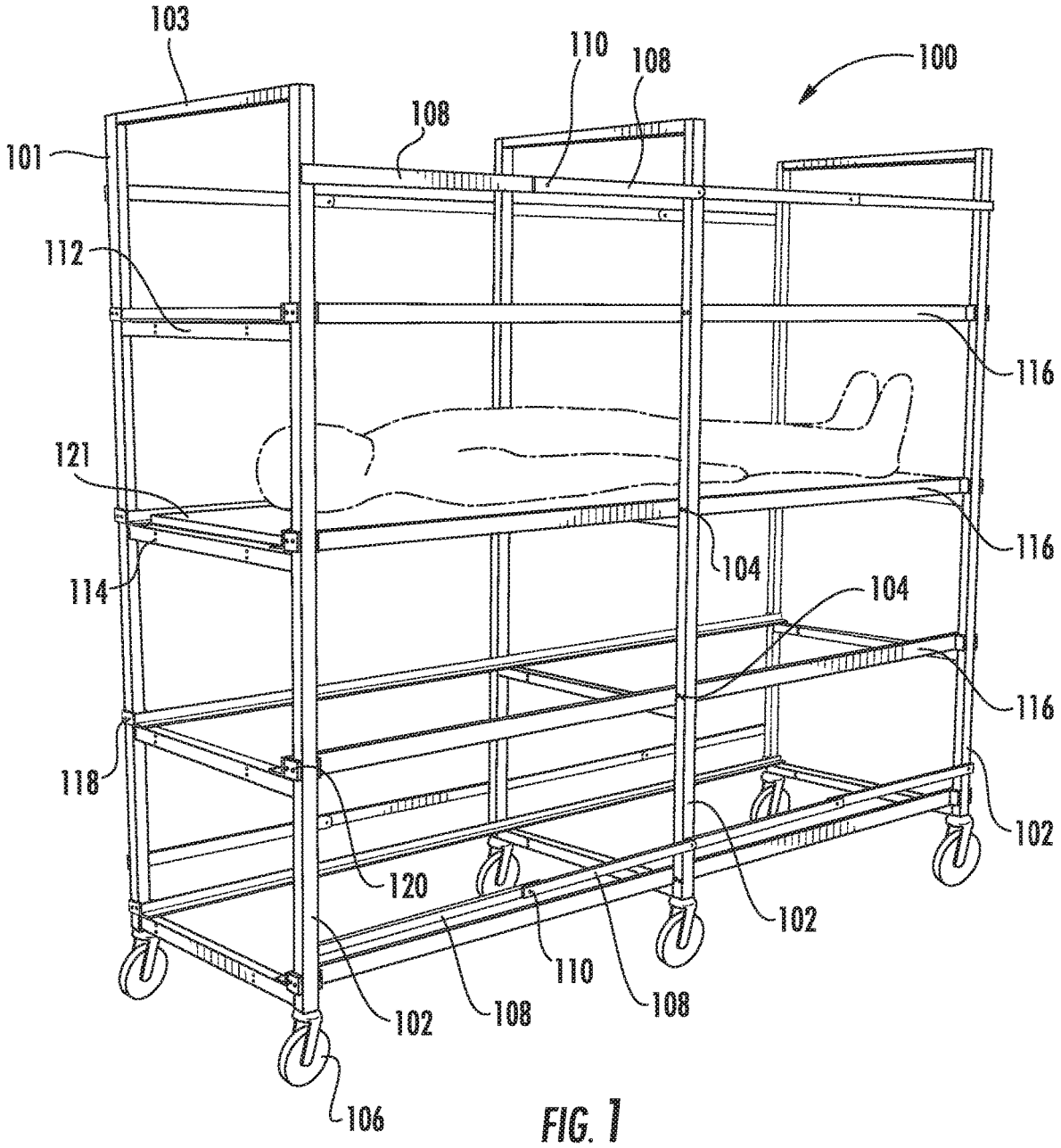
FIG. 1 is a perspective view of a collapsible cadaver rack in the first open position where a cadaver transfer board with a cadaver is placed in the rack in accordance with an embodiment of the present invention.

Repeat use of reference characters in the present specification and drawings is intended to represent same or analogous features or elements of the invention.

DETAILED DESCRIPTION OF THE INVENTION

Reference will now be made in detail to various embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
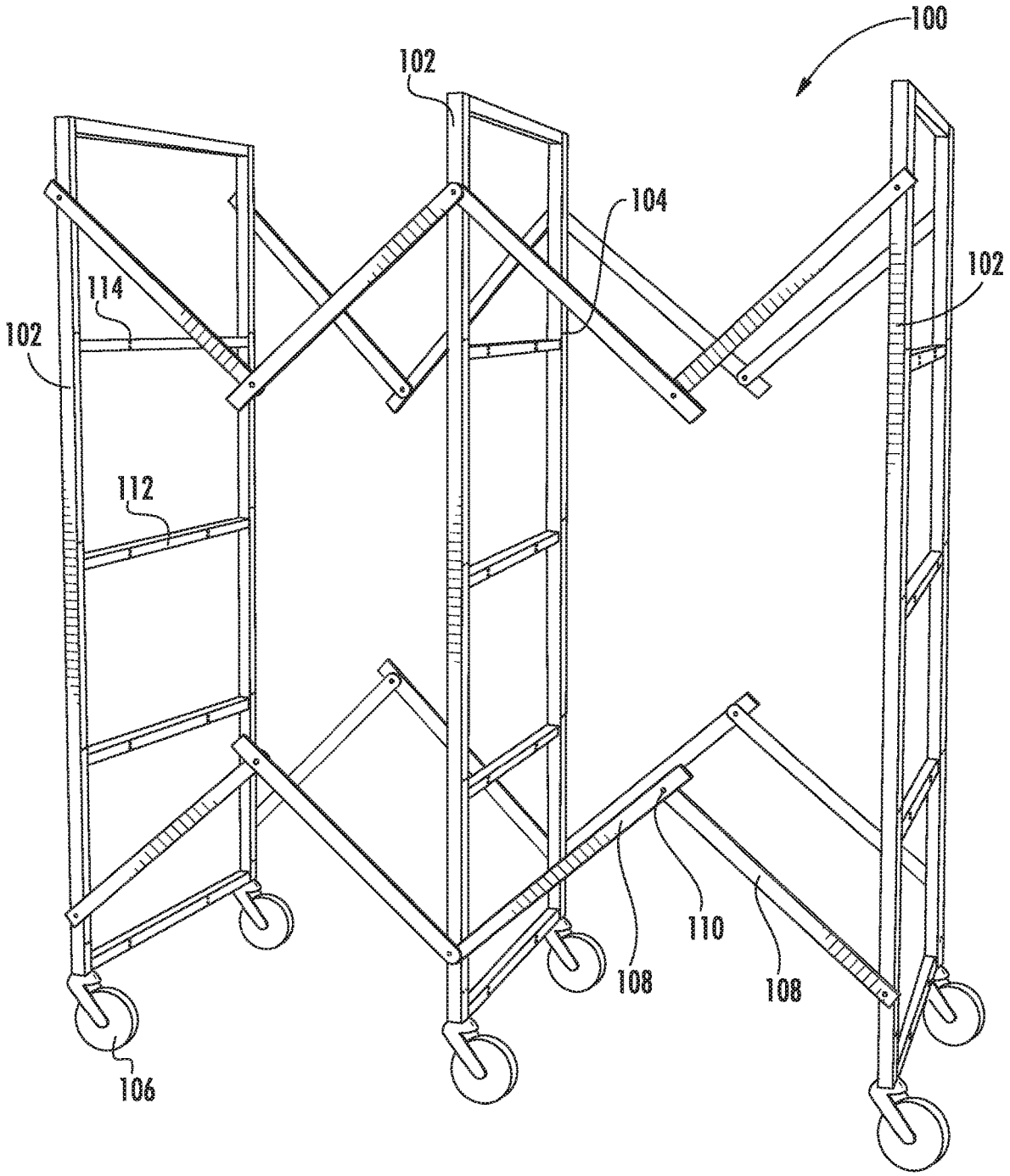
FIG. 2 is a perspective view of a collapsible cadaver rack in an intermediate position in accordance with an embodiment of the present invention.
Figure 3:
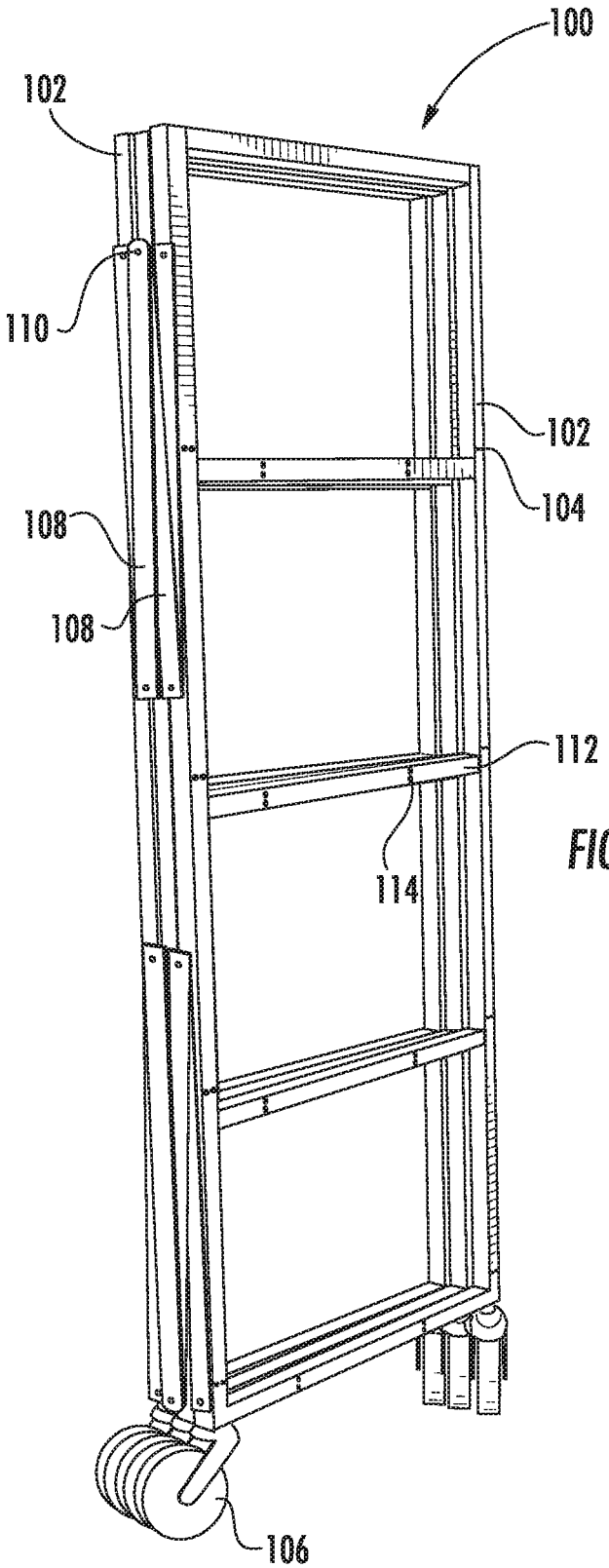
FIG. 3 is a perspective view of a collapsible cadaver rack in the second collapsed position in accordance with an embodiment of the present invention.

FIGS. 1 through 3 illustrate a collapsible cadaver rack 100 in three different positions in accordance with an embodiment of the present invention. FIG. 1 illustrates collapsible cadaver rack 100 in a first, open and transportable position, while FIG. 3 illustrates collapsible cadaver rack 100 in a second, collapsed and storable position. FIG. 2 shows the collapsible cadaver rack 100 in an intermediate position between the first open position and the second collapsed position.

Cadaver rack 100 may be constructed of three or more vertically-oriented geometrically-shaped supports 102 with varied spacing. Supports 102 may contain a series of bores 104 as shown in FIG. 1. In some embodiments, collapsible cadaver rack 100 may also contain wheels 106 to facilitate the movement of rack 100. In one embodiment, shown in FIGS. 1 through 3, supports 102 may be rectangular in shape and formed from two long vertical members 101 and two shorter horizontal members 103. In various embodiments, supports 102 may be constructed of any material suitable for the intended use of cadaver rack 100 and may be of any geometric shape in order to meet that intended use. For example, in additional embodiments, vertically-oriented geometrically-shaped supports 102 may be configured in the shape of a square, a circle, a triangle, or a parallelogram. Additionally, although FIGS. 1 through 3 show collapsible cadaver rack 100 with three equally-spaced supports 102, any number of supports 102 may be utilized in additional embodiments. For example, collapsible cadaver rack 100 may be constructed with two, three, four, or more supports 102.

Further, supports 102 of collapsible cadaver rack 100 need not be equally spaced as illustrated in FIGS. 1 through 3. In additional embodiments, for example, when collapsible cadaver rack 100 is constructed with four supports 102, the space between the outer supports and the inner supports may vary from the space between the two inner supports. In additional embodiments, the spacing may be variable.

Adjacent supports 102 are collapsibly connected by frame members 108. In one particular embodiment, adjacent frame members 108 may be connected by a hinge 110. As shown in FIG. 2, eight frame members 108 may be utilized to collapsibly connect each adjacent supports 102, or in additional embodiments, a greater or fewer number of frame members 108 may be used. For example, adjacent supports 102 may be connected by four members, twelve members, or sixteen or more members. In additional embodiments, hinges 110 may be equipped with locks (not shown) to ensure that frame members 108 maintain a substantially horizontal orientation while collapsible cadaver rack 100 is in the first open position.

Horizontal support beams 112 are connected within each support 102. The number of horizontal support beams 112 within each support 102 may correspond to the maximum number of cadavers in horizontal orientation that may be transported while using collapsible cadaver rack 100. In some embodiments, horizontal support beams 112 are placed at the same location within each support as shown in FIGS. 1 through 3. Although the embodiment illustrated in FIGS. 1 through 3 contains four horizontal support beams 112 per support 102, collapsible cadaver rack 100 may contain varying amounts of horizontal support beams 112 in additional embodiments. For example collapsible cadaver rack 100 may contain two, three, four, or more horizontal support beams 112 per support in various embodiments. Further, horizontal support beams 112 may be equipped with a series of bores 114 as illustrated in FIGS. 1 through 3.

Figure 6:
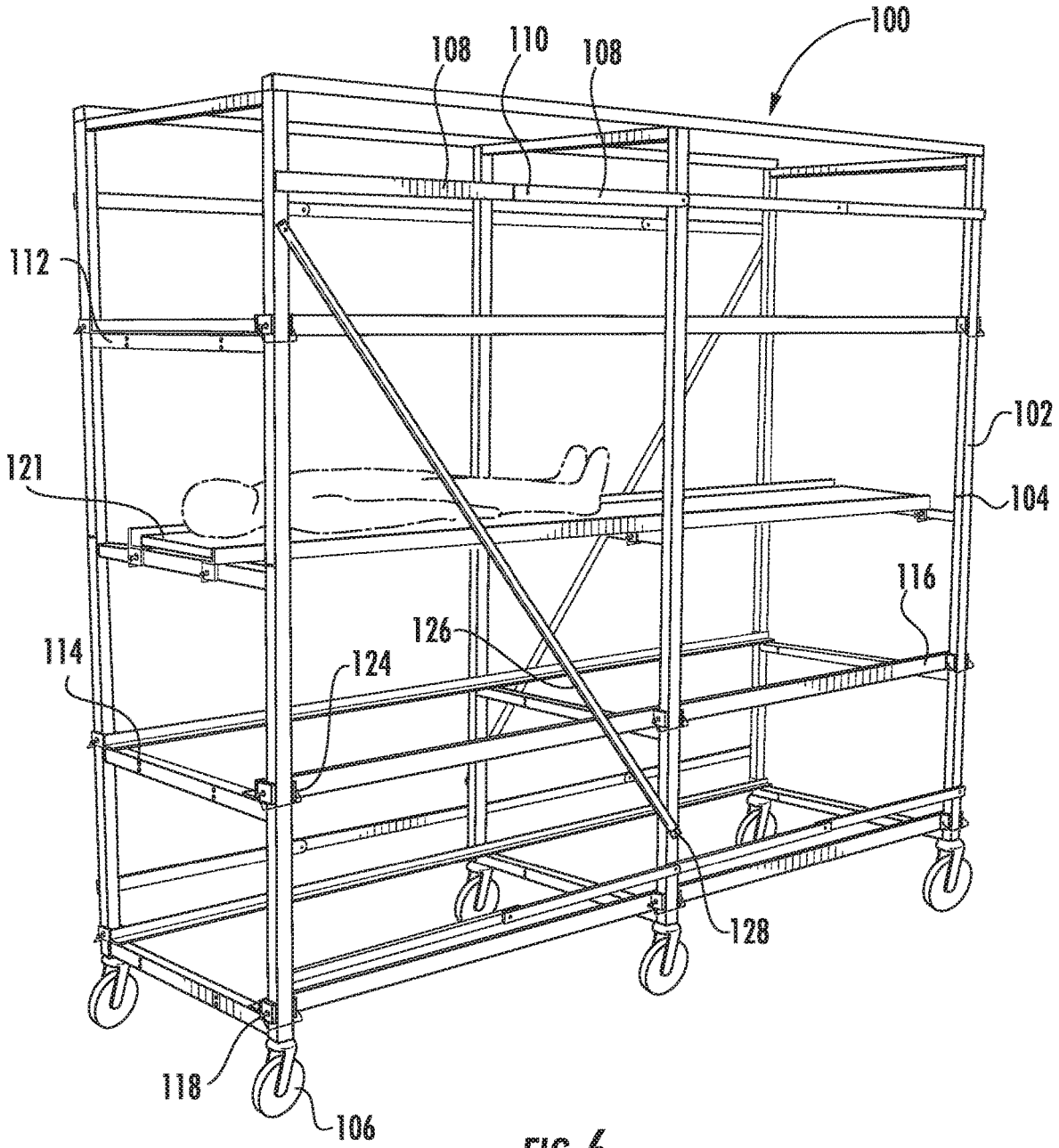
FIG. 6 is a perspective view of a collapsible cadaver rack in the first open position where a cadaver transfer board with a cadaver is placed in the rack in accordance with another embodiment of the present invention.

When collapsible cadaver rack 100 is in the first open position, removable guide rails 116 may be positioned adjacent to horizontal support beams 112. As seen in FIGS. 1 and 6, guide rails 116 may extend the length of collapsible cadaver rack 100 on each side, abutting each horizontal support beam 112 of each support 102 that is of a similar height. In some embodiments, removable guide rails 116 contain "U" shaped brackets 118 with holes 120 on either side of the bracket for either receiving a support 102 or a horizontal support beam 112.

Figure 4:
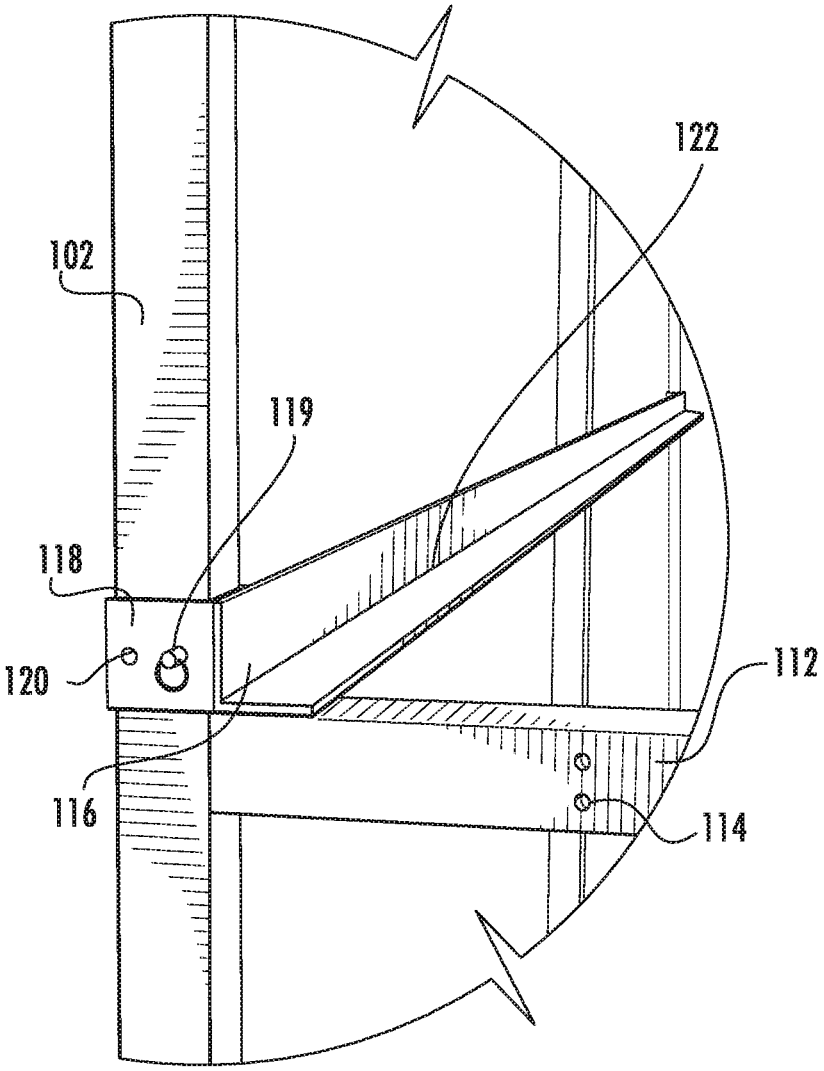
FIG. 4 is a perspective view of a removable guide rail connected to a rectangular shaped support in accordance with an embodiment of the present invention.
Figure 5:
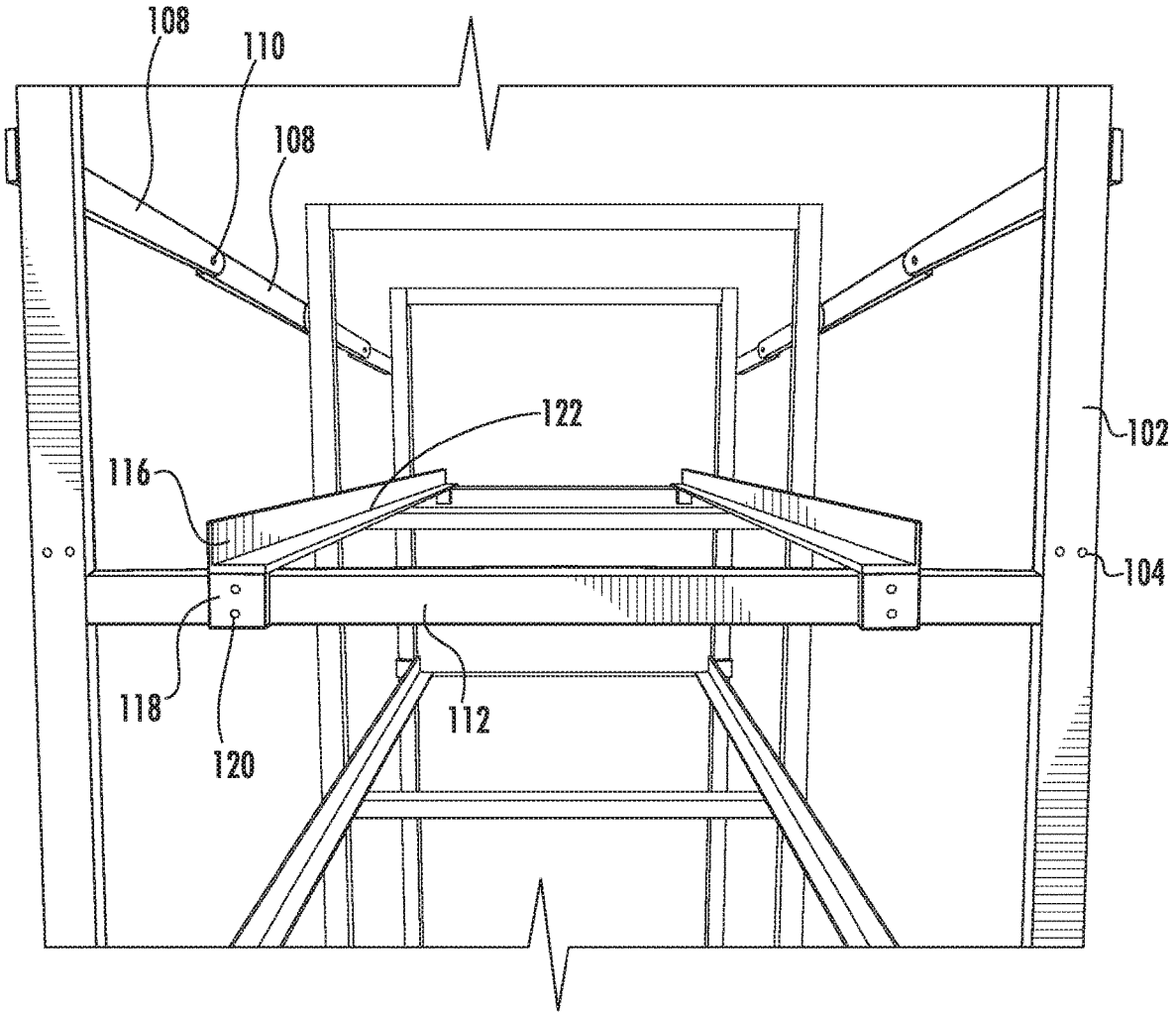
FIG. 5 is a partial perspective view of a collapsible cadaver rack in a first open position where removable guide rails are connected to a horizontal support beam in accordance with an embodiment of the present invention.

In some embodiments, collapsible cadaver rack 100 may further contain transfer boards 121, which may be received by removable guide rails 116. Transfer boards 121 may be used to facilitate the carrying of cadavers or human bodies as shown in FIG. 1. Removable guide rails 116 may be constructed in any manner to receive transfer board 121. In one embodiment, each removable guide rail 116 may be constructed of an "L" shaped rail 122, as seen in FIGS. 4 and 5, that allows one side of transfer board 121 to rest firmly on guide rail 116. In an additional embodiment, removable guide rail 116 may be created from a "C" shaped rail (not shown). Such a configuration may ensure that a cadaver transfer board which is placed within two "C" shaped rails does not move in either a vertical or horizontal direction.

In operation, in some embodiments, a user may move collapsible cadaver rack 100 into a first open position by applying appropriate force to the underside of frame members 108 near hinges 110 such that frame members 108 become substantially horizontal. Once frame members 108 are substantially horizontal, two removable guide rails 116 may be added to abut each similarly positioned horizontal support beam 112. Removable guide rails 116 may be placed at varying positions along horizontal support beam 112 or support 102 to accommodate the width of the transfer board utilized. For example, if the user requires the largest width available, removable guide rails 116 may be situated adjacent a portion of support 102. In embodiments where a "U" shaped bracket 118 is utilized on removable guide rails 116, bracket 118 may receive a vertical portion of support 102, as shown in FIG. 4. If the user requires a smaller width, guide rails 116 may be positioned at any desired point on support beams 112. For example, in the embodiment where a "U" shaped bracket 118 is utilized on removable guide rails 116, guide rails 116 may be situated such that bracket 118 receives a portion of horizontal support beam 112 as shown in FIG. 5.

Figure 7:
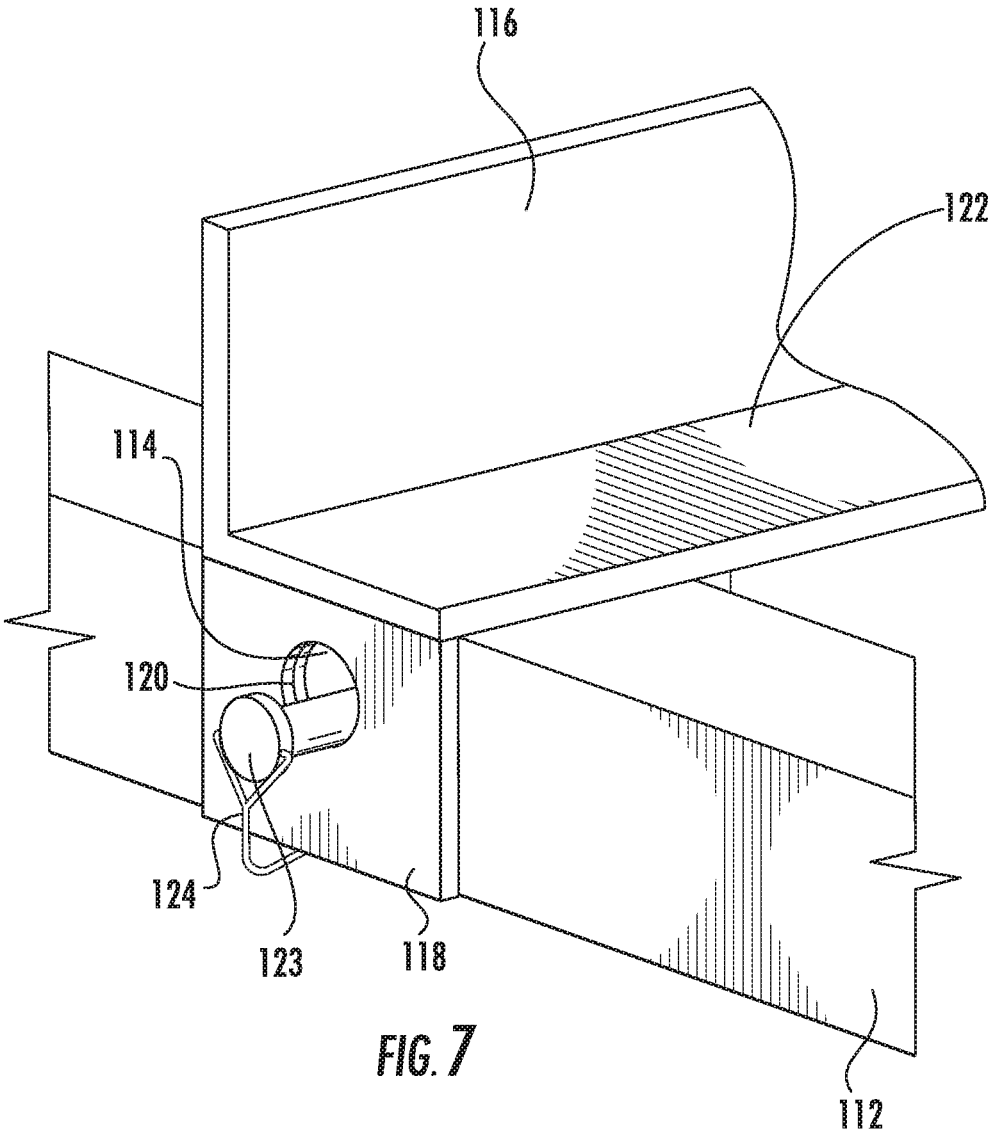
FIG. 7 is a perspective view of a bracket connected to a horizontal beam by a pin and a cable in accordance with another embodiment of the present invention.

In some embodiments, a user may secure the connection between removable guide rails 116 and either rectangular shaped support 102 or support beams 112 with the use of a pin 119 as shown in FIG. 4. For example, when bracket 118 is utilized on guide rail 116, holes 120 of bracket 118 may be aligned with a bore 104 or 114 of support 102 or horizontal support beam 112, and pin 119 may be positioned therethrough. Suitable pins for use in the present invention could include cotter pins, tab lock pins, pull pins, lynch pins, clevis pins, release pins, detent ring pins, along with others pins. In additional embodiments, any device capable of securing removable guide rail 116 to either support 102 or horizontal support beam 112 may be utilized. For example, in some embodiments, a screw and nut may be used to secure removable guide rail 116 to either support 102 or horizontal support beam 112. In other embodiments, as illustrated in FIGS. 6 and 7, guide rails 116 with bracket 118 may be secured to support 102 or horizontal support beam 112 with the use of pins 123 that are each equipped with a bulb portion (not shown) and are connected by a cable 124. In such an embodiment, holes 120 of bracket 118 may be aligned with the bore 104 or 114 of either support 102 or horizontal support beam 112 and the bulb portion of one pin 123 may be inserted through one side of bracket 118 and inside the corresponding bore 104 or 114 causing a secure connection. In some embodiments, the bulb portion of the opposite pin 123 may be inserted in the opposing side of bracket 118 and either bore 104 or 114 as shown in FIG. 6. When guide rails 116 are secured into place, a cadaver transfer board may be placed in collapsible cadaver rack 100, along at least one guide rail 116.

From the first open position, when a user wishes to utilize collapsible cadaver rack 100 in a second collapsed position, the user may start by removing guide rails 116 from collapsible cadaver rack 100. In some embodiments, the user then places the appropriate force on hinges 110 and pushes supports 102 in one direction until frame members 108 are in a substantially vertical position as seen in FIG. 3. According to a particular embodiment, when rack 100 is in the second collapsed position, frame members 108 do not extend above or below rack 100.

In some embodiments, as shown in FIG. 6, removable support braces 126 may be utilized to provide additional support to collapsible cadaver rack 100 when it is in a first open position. Removable support braces 126 may be connected to adjacent supports 102, on a single side or on both sides (as shown) and may be oriented horizontally, or diagonally as shown in FIG. 6. In some embodiments, removable support braces 126 are equipped with holes 128 at each end that are aligned with cavities (not shown) formed in supports 102. Once aligned, any device capable of connecting removable support braces 126 and supports 102 may be utilized, for example, a screw and nut or a pin as discussed above. The connection between removable support braces 126 and supports 102 may be accomplished in any manner to meet the user's specifications. When the user wishes to maintain rack 100 in a second collapsed position, removable support braces 126 may be disconnected from supports 102, and rack 100 may be collapsed as discussed above.

Figure 8:
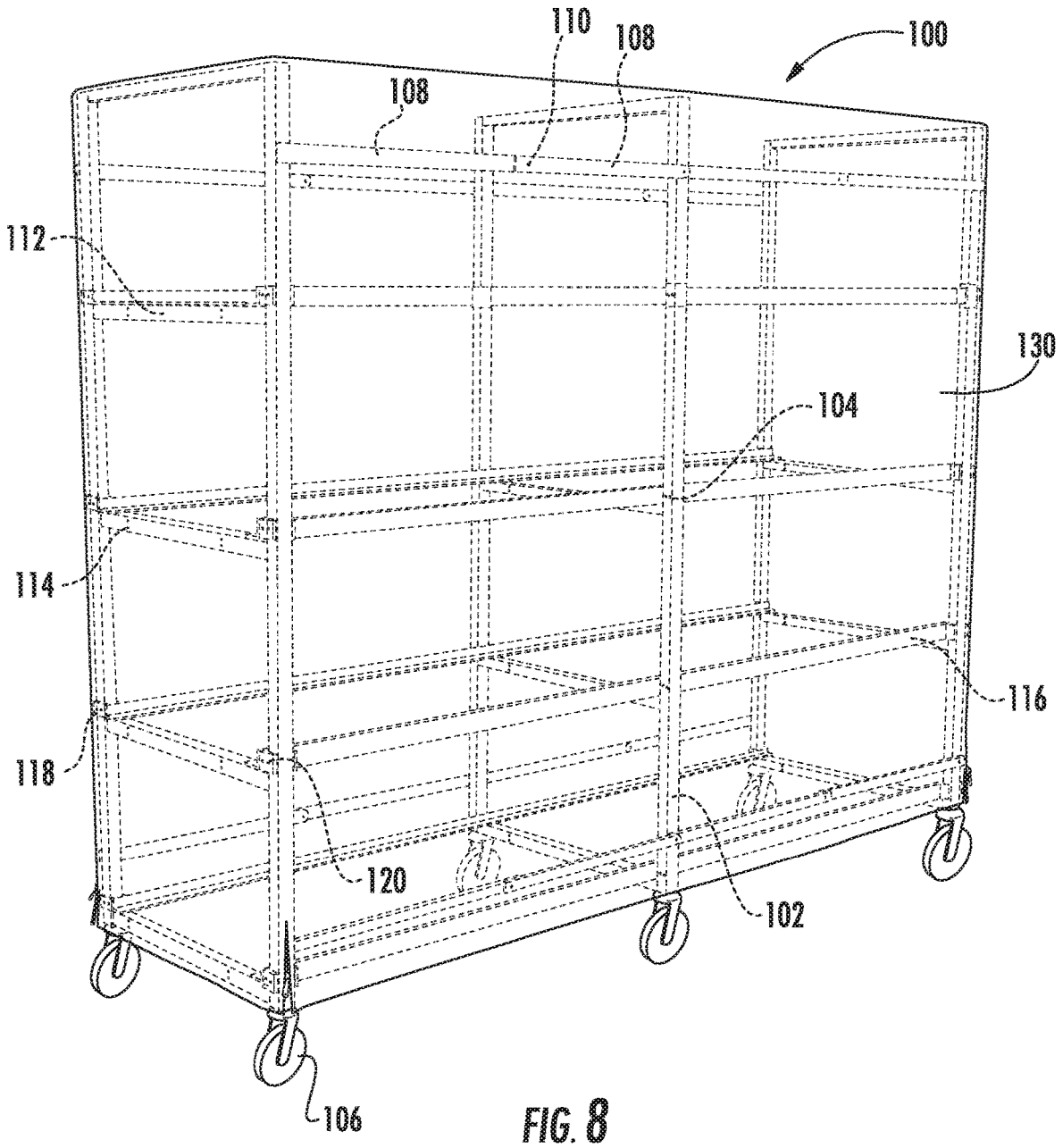
FIG. 8 is a perspective view of a partially transparent cover placed over a collapsible cadaver rack in the first open position in accordance with an embodiment of the present invention.

In some embodiments, as shown in FIG. 8, collapsible cadaver rack 100 may further include a cover 130. Cover 130 may be utilized, in some embodiments, to aid in maintaining the temperatures of the cadavers or to protect the cadavers from any outside debris. In other embodiments, cover 130 may be used to keep cadavers out of sight from an outside observer. In some embodiments, cover 130 may be equipped with one or more zippers, to ensure a more secure fit over collapsible cadaver rack 100. Cover 130 may be made of any material known in the art to perform its intended function and may be transparent, opaque, or semi-transparent. For example, cover 130 may be constructed of aluminized vinyl, aluminized fiberglass, aluminized Kevlar, aluminized cotton, aluminized polyester, PVC coated vinyl, nylon, or other materials. Those skilled in the art will recognize the wide array of materials that may be used to construct cover 130.

Figure 9:
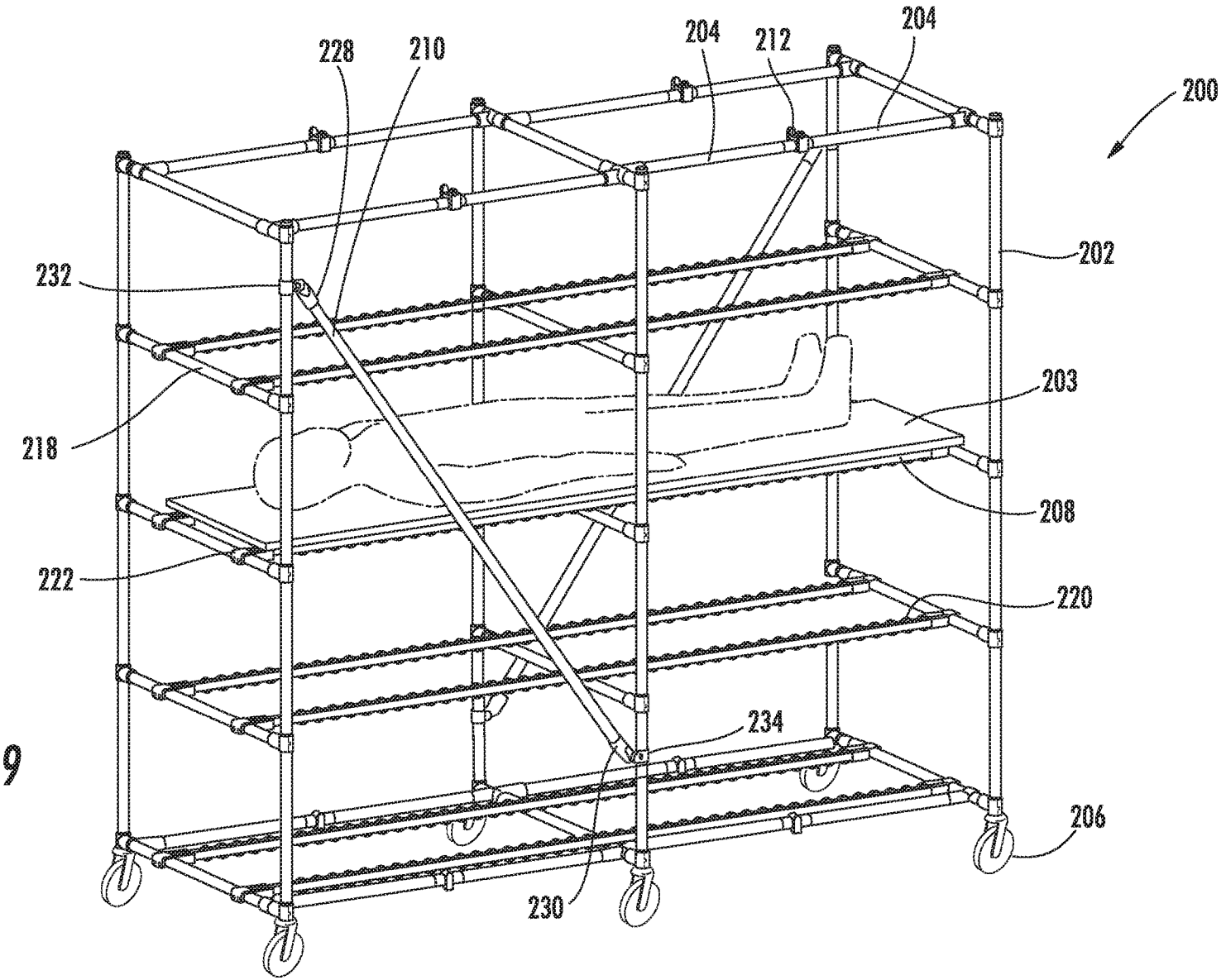
FIG. 9 is a perspective view of a collapsible cadaver rack in a first open position where a cadaver transfer board with a cadaver is placed in the rack in accordance with a further embodiment of the present invention.
Figure 10:
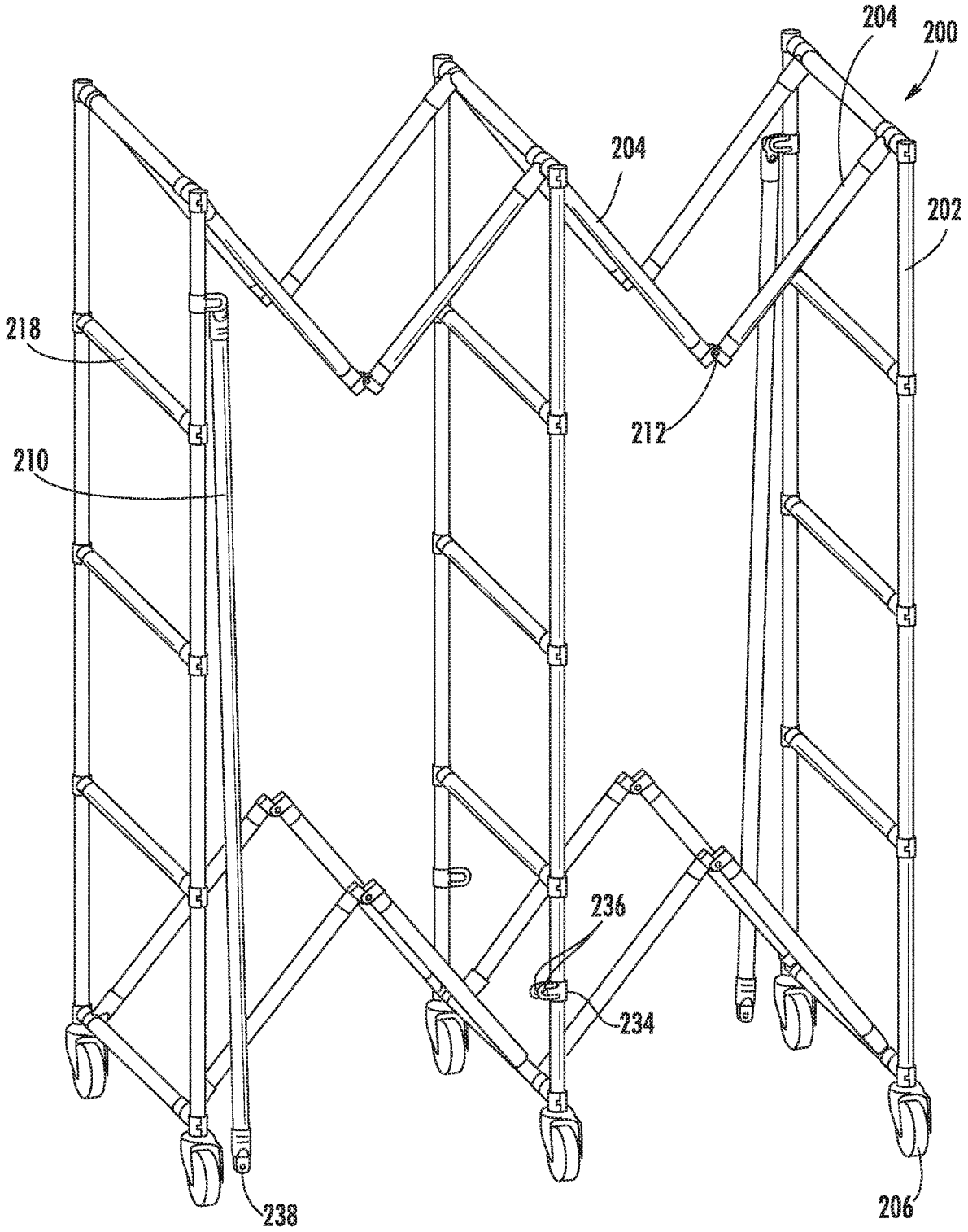
FIG. 10 is a perspective view of the collapsible cadaver rack in an intermediate position in accordance with a further embodiment of the present invention.
Figure 11:
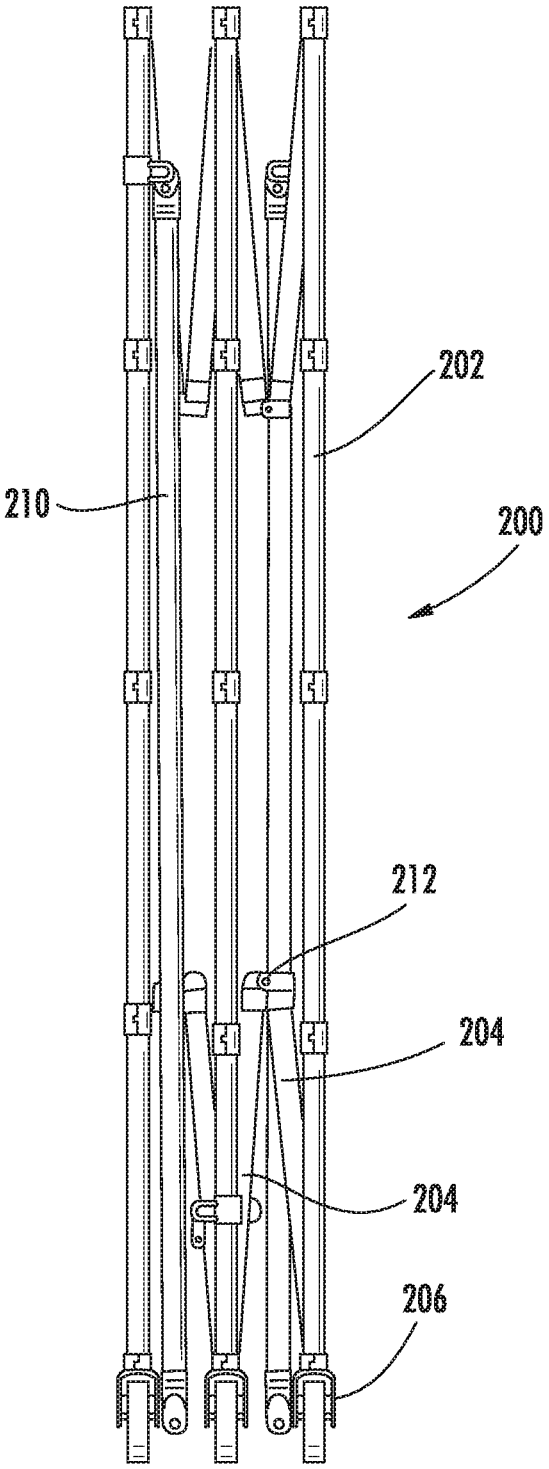
FIG. 11 is a perspective view of a collapsible cadaver rack in the second collapsed position in accordance with a further embodiment of the present invention.

FIGS. 9 through 15 show an alternative embodiment in which collapsible cadaver rack 200 comprises vertically-oriented geometrically-shaped supports 210, collapsible frame members 204, wheels 206, removable guide rails 208, and single-end disengageable support braces 210. As discussed above with respect to the embodiment shown in FIGS. 1 through 5, cadaver rack 200 may be oriented in a first open position as shown in FIG. 9, in a second, closed position as shown in FIG. 11, or in an intermediate position as shown in FIG. 10.

Figure 12:
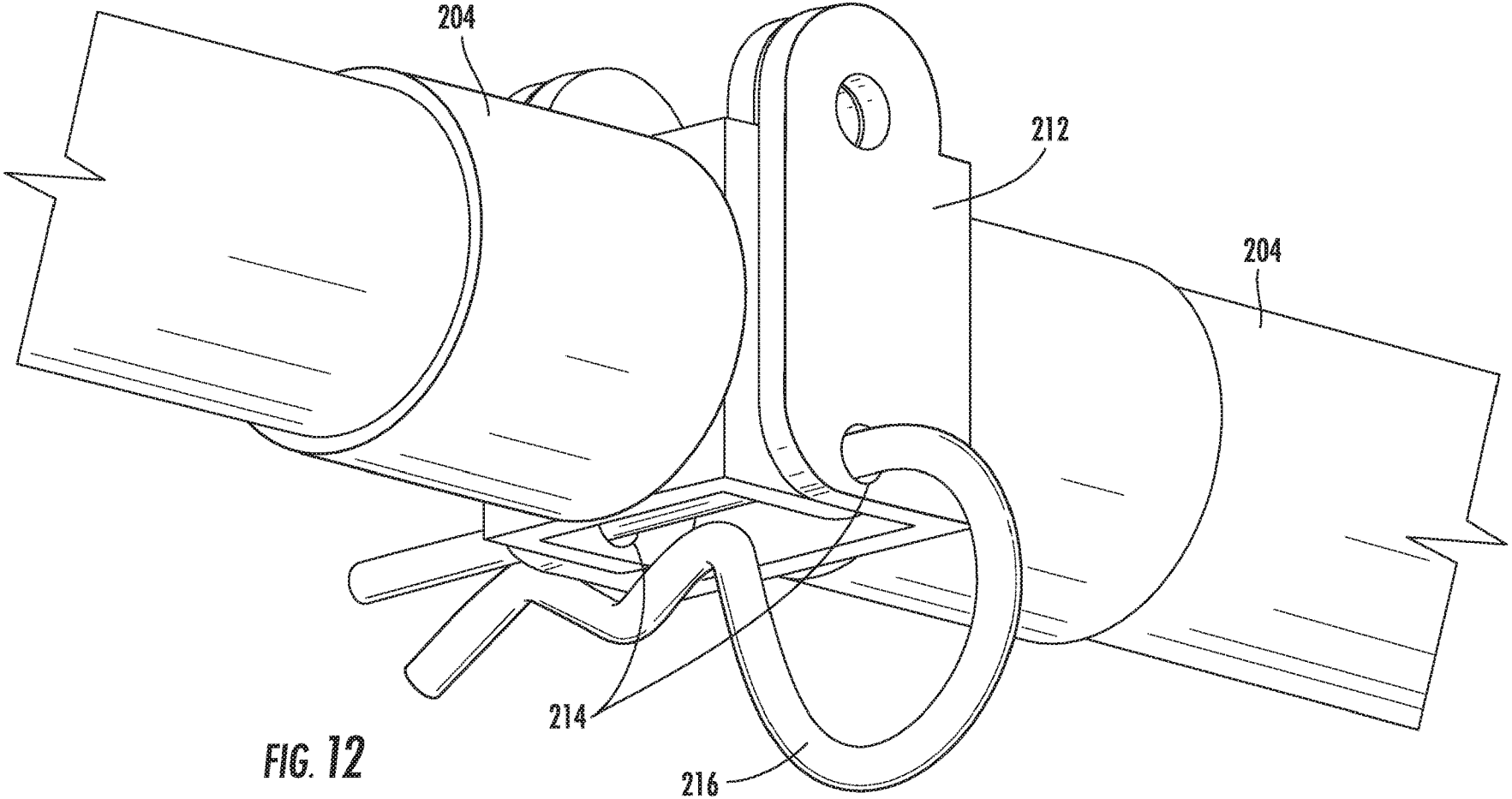
FIG. 12 is a perspective view of two collapsible frame members connected by a hinge that utilizes a pin in accordance with a further embodiment of the present invention.

Adjacent supports 202 of collapsible rack 200 are collapsibly connected by frame members 204 and adjacent frame members 204 may be connected by a hinge 212. As seen in FIG. 12, hinge 212 includes a series of holes 214 that are substantially aligned and may receive a cotter pin 216, or other similar securing device, when adjacent collapsible frame members 204 are in a substantially horizontal position. Cotter pin 216 may serve to maintain adjacent collapsible frame members 204 in a substantially horizontal orientation when collapsible cadaver rack 200 is in a first position. Although hinge 212 is shown using a cotter pin 216, any item may be utilized to maintain adjacent collapsible frame members 204 in a substantially horizontal orientation. For example, suitable items could include a screw and nut, a tab lock pin, a pull pin, a lynch pin, a clevis pin, a release pin, a detent ring pin, or any other item known in the art.

Vertically-oriented geometrically-shaped supports 202 comprise horizontal support beams 218 within each support 202. In some embodiments, support beams 218 are placed at the same location within each support 202, as shown in FIGS. 9 and 10. Again, as discussed above, the number of horizontal support beams 218 within supports 202 may correspond to the maximum number of cadavers or human bodies that may be placed within collapsible cadaver rack 200.

When collapsible cadaver rack 200 is in a first open position, removable guide rails 208 may be positioned adjacent horizontal support beams 218 as shown in FIG. 9. In some embodiments, collapsible cadaver rack 200 may further contain transfer boards 203, which may be received by removable guide rails 208. Transfer boards 203 may be used to facilitate the carrying of cadavers or human bodies as shown in FIG. 9.

Figure 13:
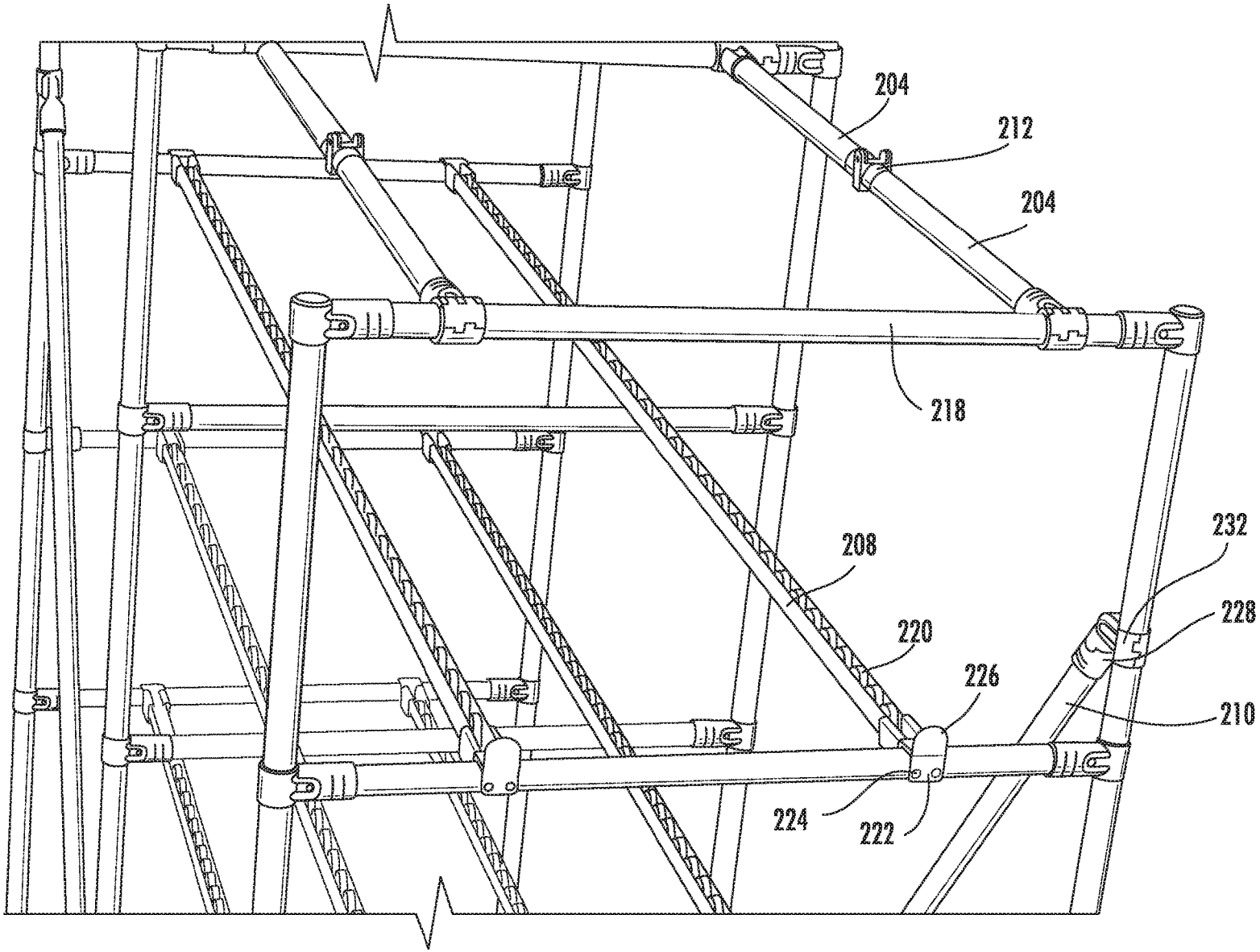
FIG. 13 is a partial top perspective view of a collapsible cadaver rack in a first open position in accordance with a further embodiment of the present invention.

In some embodiments, removable guide rails 208 may include rollers 220 that extend the entire length of each guide rail 208 as seen in FIG. 13. Rollers 220 may be utilized to aid in sliding transfer board 203 along removable guide rails 208, when transfer board 203 is utilized. Although FIG. 13 illustrates rollers 220 extending the entire length of rack 200, any number of rollers 220 may be used to meet the user's specifications.

As discussed above in reference to removable guide rail 116, removable guide rail 208 may be constructed in any configuration to meet a user's specification. For example, removable guide rail 208 may be constructed of an "L" shaped rail or a "C" shaped rail. Such configurations may ensure that a transfer board 203, when placed on removable guide rails 208, will not move in a vertical or horizontal direction.

Figure 14:
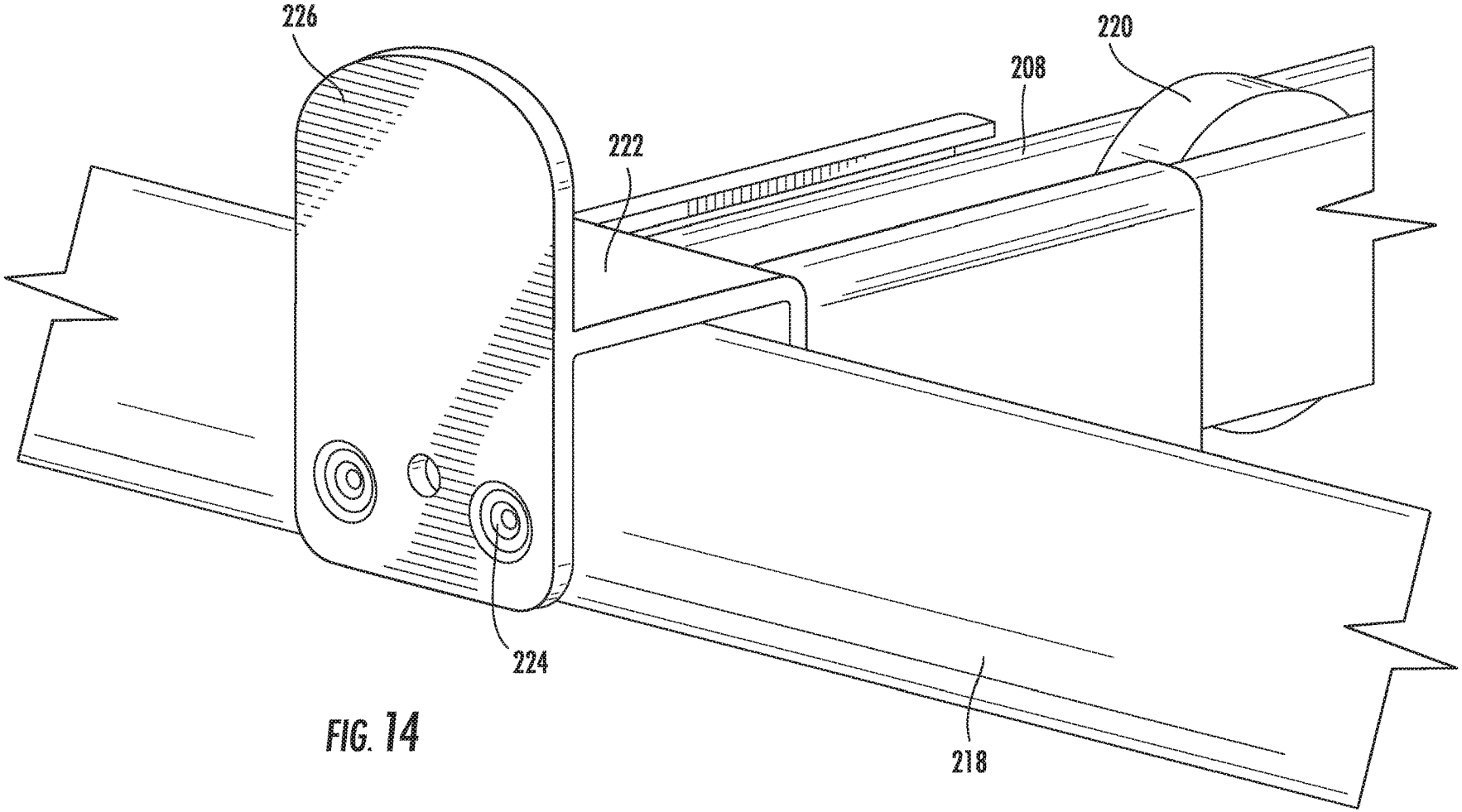
FIG. 14 is a perspective view of a removable guide rail attached to a horizontal support beam with the use of a "U" shaped bracket in accordance with a further embodiment of the present invention.

Removable guide rails 208 may also include "U" shaped brackets 222 at either end of each rail 208, as seen in FIGS. 13 and 14. In the embodiment illustrated in FIGS. 13 and 14, brackets 222 contain flexible indentions 224 and a raised tab 226.

Figure 15:
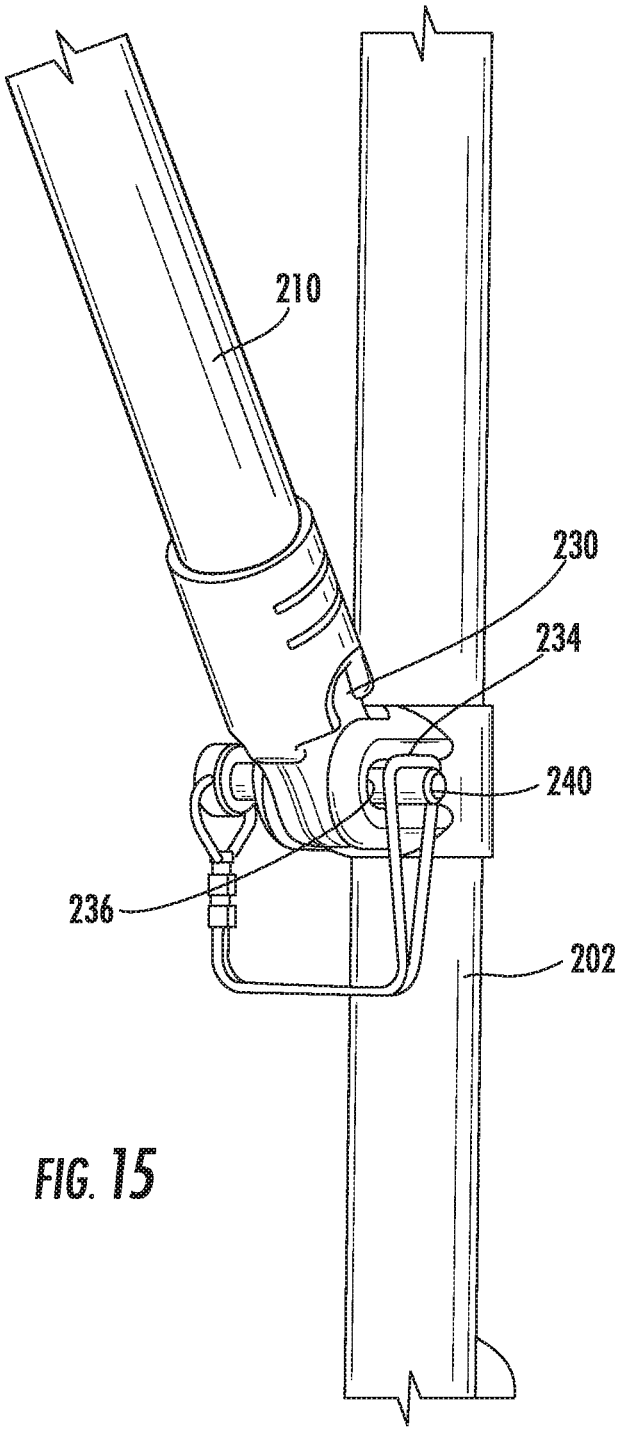
FIG. 15 is a perspective view of a second end of a brace connected to a hinge with the use of a release pin in accordance with a further embodiment of the present invention.

In some embodiments, as shown in FIG. 9, support braces 210 may be used to provide additional support to collapsible cadaver rack 200 when it is in a first open position. Removable support braces 210 may be connected to adjacent supports 202, and may be oriented horizontally, or diagonally as shown in FIG. 9. In one embodiment, support braces 210 have a first end 228 and a second end 230 that are connected to hinges 232, 234 located on supports 202. Hinge 234 contains a set of holes 236 and second end 230 contains a hole 238 (best shown in FIG. 10) such that when second end 230 is properly positioned with hinge 234, the series of holes 236 and the hole of second end 230 are aligned and may receive a release pin 240 as shown in FIG. 15. Although a release pin 240 is described and shown, any item that may maintain the connection between second end 230 and hinge 234 may be used. In other embodiments, hinge 232 and first end 228 may have similar holes to receive a pin as described above. In such embodiments, support braces 210 may be fully removable from collapsible cadaver rack 200.

As shown, supports 202, frame members 204, support braces 210, and horizontal support beams 218 may have a tubular construction. This construction may allow rack 200 to be lighter and easier to move when it is either in a first or second position. In some embodiments, the tubular construction of the above described components may allow for the addition of steel conduits (not shown) to be placed inside each component. Steel conduits may add to the stability of cadaver rack 200 and may allow for the transport of more or heavier cadavers.

In operation, a user may move collapsible cadaver rack 200 into a first position by applying appropriate force to hinges 212, such that frame members 204 are substantially horizontal. Once frame members 204 are in a substantially horizontal position, a user may add a cotter pin to holes 214 of hinge 212, as described above, to secure frame members 204 in their horizontal orientation. Additionally, a user may align the hole 238 of second end 230 of support brace 210 with the holes 236 of hinge 234 and then position a release pin therethrough. In some embodiments, a user may then place removable guide rails 208 along similarly situated horizontal support beams 218 of supports 202, as shown in FIGS. 9 and 13. Removable guide rails 208 may be placed at any position along horizontal support beam 218 to meet the user's specification and to accommodate a transfer board 203 as shown in FIG. 9. For example, if a wider transfer board is to be placed on removable guide rails 208, a user may decide to position each guide rail 208 on horizontal support beam 218 adjacent to supports 202. Once a position is determined along horizontal support beam 218, a user applies downward force to "U" shaped bracket 222, such that it receives support beam 218. As the U shaped bracket 222 receives support beam 218, flexible indentions 224 are compressed against support beam 218 such that they are substantially flush with the inside of bracket 222. After support beam 218 passes over flexible indentions 224, further into bracket 222, flexible indentions 224 return to their original position, extending inwardly into bracket 222 and thereby securing support beam 218 to bracket 222. Once removable guide rails 208 are properly positioned, a user may lay a transfer board 203 on top of guide rails 208, as shown in FIG. 9.

From the first position, when a user wishes to utilize collapsible cadaver rack 200 in a second collapsed position, the user may start by removing guide rails 208 from collapsible cadaver rack 200 by applying an appropriate amount of upward force to "U" shaped bracket 222 such that it is dislodged from support beams 218. A user may then remove release pin 240 from hinge 234 and second end 230 of support brace 210, allowing support brace 210 to swing about its first hinge 232 as shown in FIG. 10. A user may also remove cotter pin 216 from hinge 212 of collapsible frame members 204. Once cotter pin 216 is removed, the user may then place an appropriate amount of force on hinges 212 and push supports 202 in one direction until frame members 204 are in a substantially vertical position as seen in FIG. 11.

The size of the collapsible cadaver racks described above may vary based on the user's specifications. For example, if a collapsible cadaver rack is used to transport three cadavers and is in a first open position, the collapsible rack may have a length between about 5 feet and 10 feet, a width between about 1.5 feet and 4 feet, and a height between about 5 feet and 8 feet in some embodiments. In other embodiments, where the collapsible rack is used to transport three cadavers, in a first, open position, collapsible rack 10 may have a length between about 6 feet and 8 feet, a width between 2 feet and 3 feet and a height between 6 feet and 7 feet.

In some embodiments of the invention, in order to accommodate a greater number of cadavers and transfer boards, the collapsible cadaver racks described above may have a greater width to support two or more adjacent transfer boards at the same horizontal position. Such a configuration may include a greater number of guide rails attached to each support beam in order to accommodate each additional transfer board.

The collapsible cadaver racks described above may be constructed of any material suitable for transporting the transfer boards carrying cadavers. For example, the collapsible cadaver racks described above may be constructed of steel, including stainless steel, aluminum, plastic, fiberglass, or a combination of materials. Those of ordinary skill in the art will recognize the materials that may be utilized for the collapsible cadaver rack to perform its intended functions.

In some embodiments, the collapsible cadaver racks described above may contain various colors in order to identify the cadavers located on the rack. For example, in some embodiments, a collapsible cadaver rack may be colored red to indicate that there is a biohazard present. In other embodiments, the collapsible cadaver racks may be colored blue to indicate that the cadavers should be transported to a particular location. Those skilled in the art will recognize the variety of colors and designations those colors may make when associated with the collapsible cadaver racks described above.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole and in part. Furthermore, those of ordinary skill in the art will appreciate that the foregoing description is by way of example only, and is not intended to limit the invention so further described in such appended claims. Therefore, the spirit and scope of the appended claims should not be limited to the description of the preferred versions contained therein.

The invention claimed is:

1. A vertically collapsible cadaver rack, the rack comprising:

a) at least three vertically-oriented supports and at least four frame members collapsibly connecting each of the at least three vertically-oriented supports to each other such that the rack can be oriented in i) a first open position where the frame members are in a substantially horizontal position; and ii) a second collapsed, vertically upright, position where the frame members are in a substantially vertical position, wherein two of the at least three vertically-oriented supports are vertically-oriented end supports and at least one of the at least three vertically-oriented supports is a vertically-oriented center support, the collapsible cadaver rack further comprising at least one removable guide rail which connects the two vertically-oriented end supports when the rack is in the first open position and wherein the removable guide rail is not present when the rack is in the second collapsed, vertically upright, position; and b) at least two horizontal support beams internally positioned within each vertically-oriented support, wherein when the rack is oriented in the second collapsed, vertically upright position, the rack is vertically stable, and remains in a vertical position, without requiring additional vertical stabilizing support.

2. The vertically collapsible cadaver rack of claim 1 wherein the rack further comprises a cadaver transfer board adapted to receive a human cadaver and to be received by the removable guide rail when the rack is in the first open position.

3. The vertically collapsible cadaver rack of claim 1 further comprising a second removable guide rail which connects the two vertically-oriented end supports when the rack is in the first open position and wherein the second removable guide rail is not present when the rack is in the second collapsed, vertically upright position.

4. The vertically collapsible cadaver rack of claim 3 wherein the rack further comprises one or more cadaver transfer boards adapted to receive a human cadaver and to be received by the removable guide rails when the rack is in the first open position.

5. A vertically collapsible cadaver rack, the rack comprising:

a) two vertically-oriented, rectangularly-shaped, end supports and a vertically-oriented, rectangularly-shaped, center support;

b) eight hinged frame members collapsibly connecting each of the two vertically-oriented, rectangularly-shaped, end supports with the vertically-oriented, rectangularly-shaped, center support such that the rack can be oriented in i) a first open position where the frame members are in a substantially horizontal position; and ii) a second collapsed, vertically upright, position where the frame members are in a substantially vertical position; and wherein when the rack is oriented in the second collapsed, vertically upright position, the rack is vertically stable, and remains in a vertical position, without requiring additional vertical stabilizing support;

c) at least three horizontal end support beams internally positioned within each vertically-oriented, rectangularly-shaped end support for receiving a cadaver transfer board;

d) a plurality of removable guide rails corresponding in number to the number of horizontal end support beams and extending between the two vertically-oriented, rectangularly-shaped, end supports when the rack is in the first open position and wherein the plurality of removable guide rails are not present when the rack is in the second collapsed, vertically upright, position.

6. The vertically collapsible cadaver rack of claim 5 wherein the rack further comprises one or more cadaver transfer boards adapted to receive a human cadaver and to be received by the removable guide rails when the rack is in the first open position.

7. The vertically collapsible cadaver rack of claim 5 further comprising at least three horizontal center support beams internally positioned within each vertically-oriented, rectangularly-shaped center support for receiving a cadaver transfer board.

8. The vertically collapsible cadaver rack of claim 7 wherein the rack further comprises one or more cadaver transfer boards adapted to receive a human cadaver and to be received by the removable guide rails when the rack is in the first open position.

* * * * *